US006750186B2

(12) United States Patent
Black

(10) Patent No.: US 6,750,186 B2
(45) Date of Patent: Jun. 15, 2004

(54) COMPOSITION AND METHOD FOR CLEANING DISHWASHERS

(76) Inventor: Robert Black, 13675 Little Harbor Ct., Jacksonville, FL (US) 32225

( * ) Notice: Subject to any disclaimer, the term of this patent is extended or adjusted under 35 U.S.C. 154(b) by 0 days.

(21) Appl. No.: 10/355,193

(22) Filed: Jan. 31, 2003

(65) Prior Publication Data

US 2003/0148907 A1 Aug. 7, 2003

Related U.S. Application Data

(60) Provisional application No. 60/353,666, filed on Feb. 4, 2002.

(51) Int. Cl.[7] ..... C11D 1/72; C11D 3/30; C11D 17/00

(52) U.S. Cl. ..... 510/194; 510/220; 510/223; 510/224; 510/229; 510/234; 510/445; 510/446; 510/506; 134/42

(58) Field of Search ..... 510/194, 220, 510/223, 224, 229, 239, 234, 445, 446, 447, 506; 134/25.2, 42

(56) References Cited

U.S. PATENT DOCUMENTS

| | | | | |
|---|---|---|---|---|
| 3,956,164 | A | | 5/1976 | Walker et al. |
| 4,219,436 | A | | 8/1980 | Gromer et al. |
| 4,465,612 | A | | 8/1984 | Altenschopfer et al. |
| 4,545,917 | A | | 10/1985 | Smith et al. |
| 4,578,207 | A | | 3/1986 | Holdt et al. |
| 4,683,072 | A | | 7/1987 | Holdt et al. |
| 4,828,749 | A | | 5/1989 | Kruse et al. |
| 4,839,078 | A | | 6/1989 | Kruse et al. |
| 4,897,212 | A | | 1/1990 | Kruse et al. |
| 5,089,270 | A | | 2/1992 | Hampton et al. |
| 5,133,892 | A | | 7/1992 | Chun et al. |
| 5,240,632 | A | | 8/1993 | Brumbaugh |
| 5,318,713 | A | | 6/1994 | Binter |
| 5,360,567 | A | * | 11/1994 | Kuroda et al. ..... 252/90 |
| 5,453,216 | A | | 9/1995 | Kellett |
| 5,486,304 | A | | 1/1996 | Eoga et al. |
| 5,490,949 | A | | 2/1996 | Backes et al. |
| 5,492,629 | A | | 2/1996 | Ludwig et al. |
| 5,518,646 | A | | 5/1996 | Van Den Brom |
| 5,650,017 | A | | 7/1997 | Gordon et al. |
| 5,670,467 | A | | 9/1997 | Fleisher |
| 5,783,540 | A | | 7/1998 | Secemski et al. |
| 5,783,545 | A | | 7/1998 | Paatz et al. |
| 5,972,868 | A | | 10/1999 | Athey et al. |
| 6,194,368 | B1 | | 2/2001 | Waschenbach et al. |
| 6,271,190 | B1 | * | 8/2001 | Boskamp et al. ..... 510/446 |
| 6,380,141 | B1 | * | 4/2002 | Gordon ..... 510/224 |
| 6,551,982 | B1 | * | 4/2003 | Ricci et al. ..... 510/446 |
| 2002/0068688 | A1 | * | 6/2002 | Callaghan et al. ..... 510/446 |
| 2002/0082186 | A1 | | 6/2002 | Smith |
| 2003/0032568 | A1 | * | 2/2003 | Binger ..... 510/194 |

FOREIGN PATENT DOCUMENTS

| | | | |
|---|---|---|---|
| WO | WO 01/62886 | * | 8/2001 |

OTHER PUBLICATIONS

"Dishwasher Magic Plus", Product Disherwasher Magic, LLC 2002 [online] [retrieved on Feb. 4, 2002] Retrieved from Disgwasher Magi website using Internet <URL:http://dishwashermagic.com/dishwasher/product.htm>.

* cited by examiner

*Primary Examiner*—Gregory Del Cotto
(74) *Attorney, Agent, or Firm*—Browdy and Neimark, P.L.L.C.

(57) ABSTRACT

A tablet or pellet for cleaning mineral deposits from the interior of a dishwasher machine is placed within the machine, and the machine is run through its normal dishwashing cycle. The pellet or tablet is formed of a mixture of a binder matrix and a chelating agent capable of carrying out chelation solubilization on the mineral deposits. The pellet or tablet withstands substantial dissolving during the initial rinse cycle or cycles, and then dissolves to provide a pH no greater than 6 during the wash cycle.

9 Claims, No Drawings

COMPOSITION AND METHOD FOR CLEANING DISHWASHERS

The present application claims priority from copending provisional application No. 60/353,666, filed Feb. 4, 2002, now abandoned the contents of which are hereby incorporated by reference.

FIELD OF INVENTION

The present invention relates to a composition and method for cleaning automatic mechanical dishwashers, and particularly for removing mineral deposits from dishwasher interiors, and maintaining the interior surfaces of dishwashers free of such mineral deposits.

BACKGROUND OF INVENTION

The typical dishwasher cycle consists of one or more initial rinsing cycles followed by a washing cycle, and then further followed by additional rinsing cycles to remove detergent from the dishes. The dishwasher is customarily attached to a hot water supply so that the rinse cycles are carried out with warm to hot water at a temperature usually less than 120° F., i.e. about 49° C. The wash cycle is normally carried out at a temperature of about 160° F., i.e. about 71° C., or greater.

Dishwasher interiors tend to develop deposits of white and gray materials caused by the deposition of insoluble minerals from the water supply, particularly in "hard" water areas. These minerals usually include at least calcium carbonate, but often include carbonates and/or oxides of magnesium, iron and other insolubles. Insofar as is known, the aforementioned problem has not been solved.

While some "dishwasher detergents", i.e. detergents used in automatic dishwashers for washing dishes, may help prevent the aforementioned deposits during the so-called "wash" cycle, the problem which exists is that automatic dishwashers invariably go through a series of rinse cycles following the wash cycle, and the aforementioned deposits build up from repeated rinse cycles over days, weeks and months. Even those dishwasher detergents which may tend to inhibit deposition of minerals during the wash cycle are not very effective in this regard and in any event do not serve to wash away such minerals which have already been deposited from previous cycles. Moreover, most dishwasher detergents are employed at a neutral to alkaline pH, which is not conducive to removal of mineral deposits.

Altenschopfer et al U.S. Pat. No. 4,465,612 relates to a product for cleaning and maintaining the interior surfaces of a mechanical dishwasher, but this is a liquid product and therefore is dissipated and washed away during the first cycle of the machine, usually a rinse cycle preceding the wash cycle. The cleaning liquid disclosed in the Altenschopfer U.S. Pat. No. '612 is preferably scrubbed onto the interior surface of the dishwasher, and subsequently wiped off, before then running the dishwasher.

Another liquid product advertised as cleaning dishwashers is a product called "Dishwasher Magic"™ which also is a liquid product (see dishwashermagic.com).

Chelating agents such as EDTA and others are known to be useful for the removal of mineral deposits, often called "scale", including calcium carbonate deposits, from a variety of surfaces including pipes, heat exchangers, evaporators, filters, swimming pools and even false teeth, noting for example U.S. Pat. Nos. 5,972,868; 5,492,629; 5,486,304 and 3,956,164. The contents of these documents are incorporated by reference, insofar as they are consistent with the requirements of the present invention as described below.

SUMMARY OF INVENTION

According to the present invention, there is provided a solid dishwasher cleaner in cast or compressed tablet form which is adapted to dissolve only slightly during the initial rinse cycles at temperatures less than 110° to 120° F. (about 43° C. to about 49° C.), to then dissolve more completely during the wash cycle at temperatures greater than 110° to 120° F. (about 43–49° C.), and then to finally disperse entirely during the final rinse cycles. The composition comprises a binder or matrix that desirably dissolves sparingly in water at a temperature less than 120° F. (about 49° C.) and preferably at less than 110° F. (about 43° C.), and readily at a temperature of about 155° F. (68° C.), and which binder is also preferably a surfactant, together with a chelating agent, which composition when dissolved in water provides a pH below 6. For best results, the tablet must dissolve only slightly during the initial rinse cycle or cycles, and then disperse substantially or entirely during the wash cycle, with however preferably a small residual amount surviving until the final rinse cycle or cycles, although the composition will perform adequately even if it completely disperses during the wash cycle.

The dishwasher cleaner tablet can be placed in the dishwasher and run through a regular dishwasher cycle when the dishwasher is empty, or it can be used in conjunction with conventional dishwasher detergent when the dishwasher is loaded with dishes, although the latter type of operation is not preferred as the dishwasher detergent may result in an increase in pH above 6 whereby cleaning of the dishwasher interior will be inhibited.

The present invention will be better understood with reference to the following detailed description of exemplary embodiments thereof.

DETAILED DESCRIPTION OF EMBODIMENTS

As indicated above, the composition of the present invention includes two components which are most important, namely a matrix or binder material which will substantially survive the initial rinse cycles and having a dissolution or melting point sufficiently low so that it will largely or substantially disperse during the wash cycle and at least at a temperature of 155–160° F. (about 68–71° C.), and a chelating agent capable of attacking the inorganic deposits from the interior surfaces of the dishwasher machine, the composition in its dissolved form providing a cleaning solution having a pH lower than 6. In its simplest form, and ignoring the presence of optional other ingredients, the binder or matrix material may be present in an amount of 5% to 95% by weight, with the chelating agent being present in an amount of 95% to 5% by weight, more preferably 15%–70% binder and 30%–85% chelant, and most preferably 25%–40% binder and 75%–60% chelant.

Other ingredients are also desirably present in minor amounts, e.g. colorants, fragrances and preservatives and/or bactericides, preferably in an amount of no more than about 1% by weight of each based on the total solid composition. Other optional ingredients may also be added such as wetting agents and corrosion inhibitors, desirably in amounts no greater than about 5% by weight based on the total weight of the solid composition. More important is the provision of an antifoam agent in an amount of up to 20% of the solid composition, preferably about 1% to about 5% by weight based on the total weight of the solid composition. In addition, depending on the selection of the chelating agent and the matrix material, and whether or not the composition is designed for use with a dishwasher detergent, a small amount of a preferably solid acid may also be present to ensure that upon desolution the pH will be no greater than 6.

The function of the chelating agent is to carry out what is known as "chelation solubilization". From what appears above, it will be clear what properties are required for the chelating material, i.e. it must be capable of chelating at least the calcium ion, but preferably also the magnesium and iron ions; it is preferably an acid, or at least must be able to maintain chelating activity in an acid environment; and it should be only sparingly soluble at temperatures below about 43° C. to about 49° C., and more completely soluble at higher temperatures. If the chelating agent is not itself a solid at ambient temperatures, then it must be sufficiently compatible with the matrix or binder material so that the mixture thereof is solid at ambient temperatures and meets the aforementioned temperature dissolution requirements.

Preferred chelating materials are EDTA, citric acid, NTA, lauroyl ethylene diamine triacetic acid, oxalic acid, potassium bisulfate or EDTA variants. Mixtures of such chelating agents can also be used. Many chelating agents are known and commercially available and may be easily routinely tested for suitability according to the present invention; a list of chelating agents may be found, for example, in the Kirk-Othmer Encyclopedia of Chemical Technology, Vol. 5, Fourth Edition (1993), pages 764–795. Chelating agents for routine testing for suitability for use in the present invention may also be found in the patent literature.

The release controlling matrix or binding material can be any one of a number of solid water soluble solid materials having the property of dissolving slowly in water at temperatures below 140° F. (60° C.) and dissolving more quickly at temperatures above 150° F. (about 65.6° C.), and which preferably also have surfactant properties. These include alcohol ethoxylates, e.g. polyoxyethylated alcohols of preferably 16–20 carbon atoms, polyethylene glycol, polyvinyl pyrrolidone, polyvinyl acetate/pyrrolidone copolymers, N-acyl-N,N,N-ethylene diamine triacetic acid, etc. Other water soluble solid materials can be easily routinely tested for suitability for use in the present invention. In the case of the water soluble solid surfactants, the water solubility arises due to the suitable matrix solids having a melting point between about 60° C. and about 71° C.

If the chelating agent is an acyl ethylene diamine triacetic acid such as lauroyl ethylene diamine triacetic acid, then the matrix material cannot be the same material, i.e. an N-acyl-N,N,N-ethylenediamine triacetic acid. When such a material is used as the chelating agent, then at least 5% by weight of the composition should comprise another binder material to improve the dissolving rate and/or act as a stronger binder at temperatures below 140° F.

As regards the optional ingredients, the wetting agents may be selected from a wide variety of surface active agents including water-soluble surfactants such as synthetic anionic, non-ionic, cationic, amphoteric and zwitterionic surfactants and mixtures thereof.

If an acid other than the chelating agent is incorporated in the solid composition of the present invention, it also is desirably a solid at room temperature, or at least is an acid which is fully compatible with the binder or matrix material in the quantities utilized to maintain the desired acid pH. Acids which are solid at ambient temperatures are well known.

The tablet of the present invention may be formed either by casting a melt of the components or by compression molding of thoroughly mixed powders according to well known techniques. For the typical sized home dishwasher, the size of the tablet is suitably 10–17 grams, but other sizes are also possible.

The present invention will be further understood from a consideration of the following illustrative examples which are intended to be purely exemplary, and not limitative.

EXAMPLE 1

A mixture of 60% by weight EDTA and 40% by weight polyoxyethylated C16–C20 alcohol (Rhodasurf TP-970 FLK) is heated to 200° F. and stirred until uniform. The resultant molten material is poured into cylindrical molds of size to produce tablets of 15 grams, and the melt is allowed to cool.

In use, a resultant tablet is placed in the silverware basket in a dishwasher, and the dishwasher is run through its cycle. The tablet withstands the initial rinsing and dissolves during the wash cycle, providing substantial removal of stains and mineral deposits from the interior surface of the dishwasher.

EXAMPLE 2

| Composition: | % by weight |
|---|---|
| EDTA Acid from Dow or Akzo | 65.5 |
| Rhodasurf TB-970[1] from Rhodia | 32.0 |
| Anti-foaming Agent (Dow Corning 1920) | 1.5 |
| Cinnamon Fragrance | 1.0 |

[1]Rhodasurf TB-970 from Rhodia is an alcohol ethoxylate with a melting point of 155° F.

The ingredients are mixed and melted at 100° C. and poured into molds to make 15 gram pellets or tablets. In a second batch, the dry powders are mixed and pressed to form 16 gram pellets. Such a pellet or tablet is used as described above in Example 1, with good cleaning and less foam generation.

EXAMPLE 3

| Composition: | % by weight |
|---|---|
| EDTA Acid from Dow or Akzo | 62.0 |
| Polymer Matrix (5% polyethylene glycol and 30.5% Rhodasurf TB-970) | 35.5 |
| Anti-foaming Agent (Dow Corning 1920) | 1.5 |
| Cinnamon Fragrance | 1.0 |

As in Example 2, the ingredients are mixed, melted at 100° C. and poured into molds to make 15 gram tablets. As in Example 2, the tablet is used to remove stains and mineral deposits from the interior surface of the dishwasher, with good results.

EXAMPLE 4

| Composition: | % by weight |
|---|---|
| EDTA Acid | 50.0 |
| Citric Acid | 20.0 |
| Polyvinylpyrrolidone | 25.0 |
| Surface Active Agent | 2.0 |
| Anti-foaming Agent | 2.0 |
| Lemon Fragrance | 1.0 |

The powders are mixed and pressed into 12 g. tablets.

EXAMPLE 5

| Composition: | % by weight |
|---|---|
| Citric Acid | 30.0 |
| NTA | 19.0 |
| Polyvinylpyrrolidone | 30.0 |
| N-acyl-N,N,N-ethylene diamine triacetic acid | 20.0 |
| Anti-Foaming Agent | 1.0 |

The powders are mixed and pressed in 12.5 g. tablets.

EXAMPLE 6

| Composition | % by weight |
|---|---|
| EDTA Acid | 62.0 |
| Pluroionic F98[2] (BASF) | 34.5 |
| Mirapol Surf-S 410[3] | 1.0 |
| Anti-Foam Agent (Dow Corning 1920) | 1.5 |
| Cinnamon Fragrance | 1.0 |

[2]Pluroinic F98 is a water soluble solid polymer surfactant from BASF having a molecular weight of 13,000.
[3]Mirapol Surf-S polymers are acrylic polymers having both cationic and anionic charges and having surfactant properties.

The foregoing description of the specific embodiments will so fully reveal the general nature of the invention that others can, by applying current knowledge, readily modify and/or adapt for various applications such specific embodiments without undue experimentation and without departing from the generic concept, and therefore such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A method of removing mineral deposits from the interior of a dishwashing machine, comprising placing dishwasher cleaner solid composition in tablet or pellet form, consisting essentially of (1) 5–95% by weight of at least one chelating agent capable of carrying out chelation solubilization of mineral deposits including calcium carbonate, wherein said chelating agent comprises EDTA, (2) 95–5% by weight of a binder matrix material for said chelating, said binder matrix material being solid at less then 120° F., and optionally (3) one or more of a colorant, fragrance, preservative, bactericide, anti-foam, acid, corrosion inhibitor and wetting agent, said solid composition being resistant to dissolving or being sparingly soluble in water at temperatures below about 49° C., and being capable of substantially dissolving at temperatures greater than 68° C. to provide a solution having a pH no greater than 6, within said dishwasher machine, and running said dishwasher machine through a dishwasher cycle.

2. A method of removing mineral deposits from the interior of a dishwashing machine, comprising placing a composition according to claim 1 within said dishwasher machine, wherein said tablet or pellet comprises pressed powders, and running said dishwasher machine through a dishwasher cycle.

3. A method of removing mineral deposits from the interior of a dishwashing machine, comprising placing a composition according to claim 1 within said dishwasher machine, wherein said composition comprises an anti-foam agent in an amount no greater than 20% by weight, and running said dishwasher machine through a dishwasher cycle.

4. A method of removing mineral deposits from the interior of a dishwashing machine, comprising placing a composition according to claim 1 within said dishwasher machine, wherein said composition comprises an anti-foam agent in an amount no greater than 5% by weight, and running said dishwasher machine through a dishwasher cycle.

5. A method of removing mineral deposits from the interior of a dishwashing machine, comprising placing a composition according to claim 1 within said dishwasher machine, wherein said composition comprises 30–85% of said chelating agent, and said binder matrix is present in an amount of 15–70% by weight, and running said dishwasher machine through a dishwasher cycle.

6. A method of removing mineral deposits from the interior of a dishwashing machine, comprising placing a composition according to claim 1 within said dishwasher machine, wherein said chelating agent is present in an amount of 60–75% by weight and said binder matrix is present in an amount of 25–40% by weight, and running said dishwasher machine through a dishwasher cycle.

7. A method of removing mineral deposits from the interior of a dishwashing machine, comprising, placing a composition according to claim 1 within said dishwasher machine, wherein said binder matrix has surfactant properties, and running said dishwasher machine through a dishwasher cycle.

8. A method of removing mineral deposits from the interior of a dishwashing machine, comprising placing a composition according to claim 1 within said dishwasher machine, wherein said binder matrix is a polyoxyethylated alcohol, and running said dishwasher machine through a dishwasher cycle.

9. A method of removing mineral deposits from the interior of a dishwashing machine, comprising placing a composition according to claim 1 within said dishwasher machine, wherein said binder matrix is selected from the group consisting of a polyoxyethylated alcohol, polyethylene glycol, polyvinyl pyrrolidone, polyvinyl acetate-pyrrolidone copolymers, N-acyl-N,N,N-ethylene diamine triacetic acid, and mixtures thereof, and running said dishwasher machine through a dishwasher cycle.

* * * * *